US009713741B1

(12) United States Patent
Tolliver

(10) Patent No.: US 9,713,741 B1
(45) Date of Patent: Jul. 25, 2017

(54) PULL-UP AND DIP DEVICE

(71) Applicant: Brian Tolliver, Mesquite, TX (US)

(72) Inventor: Brian Tolliver, Mesquite, TX (US)

( * ) Notice: Subject to any disclaimer, the term of this patent is extended or adjusted under 35 U.S.C. 154(b) by 0 days.

(21) Appl. No.: 14/842,299

(22) Filed: Sep. 1, 2015

(51) Int. Cl.

| | |
|---|---|
| ***A63B 22/00*** | (2006.01) |
| ***A63B 71/00*** | (2006.01) |
| ***A63B 69/34*** | (2006.01) |
| ***A63B 69/20*** | (2006.01) |
| ***A63B 69/22*** | (2006.01) |
| ***A63B 69/24*** | (2006.01) |
| ***A63B 21/00*** | (2006.01) |
| ***A63B 23/12*** | (2006.01) |
| ***A63B 21/068*** | (2006.01) |

(52) U.S. Cl.
CPC ..... *A63B 23/12* (2013.01); *A63B 21/068* (2013.01); *A63B 21/1469* (2013.01); *A63B 23/1218* (2013.01); *A63B 23/1227* (2013.01); *A63B 69/205* (2013.01); *A63B 2210/50* (2013.01)

(58) Field of Classification Search
CPC . A63B 23/12; A63B 23/1209; A63B 23/1218; A63B 23/1227; A63B 21/06; A63B 21/068; A63B 69/20; A63B 69/201; A63B 69/203; A63B 69/205; A63B 69/54
See application file for complete search history.

(56) References Cited

U.S. PATENT DOCUMENTS

| | | | | |
|---|---|---|---|---|
| 3,708,167 | A * | 1/1973 | Potgieter | A63B 21/0615 482/100 |
| 5,810,703 | A * | 9/1998 | Stack | A63B 22/18 482/146 |
| D401,985 | S | 12/1998 | Wheeler | |
| 6,217,483 | B1 * | 4/2001 | Kallassy | A63B 21/068 482/38 |
| 6,220,992 | B1 * | 4/2001 | Shafik | A63B 69/20 482/104 |
| 6,749,549 | B1 | 6/2004 | Chu | |
| 7,534,200 | B1 * | 5/2009 | Martinez | A63B 21/00047 482/142 |
| 7,565,990 | B2 | 7/2009 | Bryan, IV | |
| 8,267,840 | B2 | 9/2012 | Barnes | |
| 8,834,327 | B1 | 9/2014 | George, Jr. | |
| 2002/0082145 | A1 | 6/2002 | Hamilton | |
| 2005/0245370 | A1 * | 11/2005 | Boland | A63B 21/055 482/130 |
| 2005/0250624 | A1 * | 11/2005 | Yu | A61H 3/008 482/69 |
| 2006/0025285 | A1 * | 2/2006 | Giusti | A63B 69/201 482/83 |
| 2007/0197351 | A1 * | 8/2007 | Gonzalez | A63B 69/004 482/83 |
| 2008/0227609 | A1 * | 9/2008 | Barniak | A63B 3/00 482/142 |

(Continued)

*Primary Examiner* — Sundhara Ganesan
*Assistant Examiner* — Nyca T Nguyen
(74) *Attorney, Agent, or Firm* — Kyle A. Fletcher, Esq.

(57) ABSTRACT

The pull up dip device is an adjustable exercise device that is intended for home use. The pull up dip device is portable, can be easily folded for storage and optionally incorporates a plurality of spike sleeves for stability in outdoor use. The pull up dip device is adapted for use in pull ups, chin ups, dips, and speed bag use. The pull up dip device comprises a base, a post, a U bar, a plurality of post attachments, and a plurality of base attachments.

16 Claims, 6 Drawing Sheets

(56) References Cited

U.S. PATENT DOCUMENTS

| | | | | |
|---|---|---|---|---|
| 2009/0069161 | A1* | 3/2009 | Caldwell | A63B 21/00047 482/138 |
| 2012/0231937 | A1 | 9/2012 | Murphy | |
| 2014/0371040 | A1 | 12/2014 | Vasquez | |
| 2015/0065321 | A1* | 3/2015 | Goodson | A63B 21/00047 482/142 |

* cited by examiner

PULL-UP AND DIP DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of adjustable exercise devices, more specifically, a portable device for upper body strength training.

SUMMARY OF INVENTION

The pull up dip device is an adjustable exercise device that is intended for home use. The pull up dip device is portable, can be easily folded for storage and optionally incorporates a plurality of spike sleeves for stability in outdoor use. The pull up dip device is adapted for use in pull-ups, chin ups, dips, and speed bag use.

These together with additional objects, features and advantages of the pull up dip device will be readily apparent to those of ordinary skill in the art upon reading the following detailed description of the presently preferred, but nonetheless illustrative, embodiments when taken in conjunction with the accompanying drawings.

In this respect, before explaining the current embodiments of the pull up dip device in detail, it is to be understood that the pull up dip device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the pull up dip device.

It is therefore important that the claims be regarded as including such equivalent construction insofar as they do not depart from the spirit and scope of the pull up dip device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
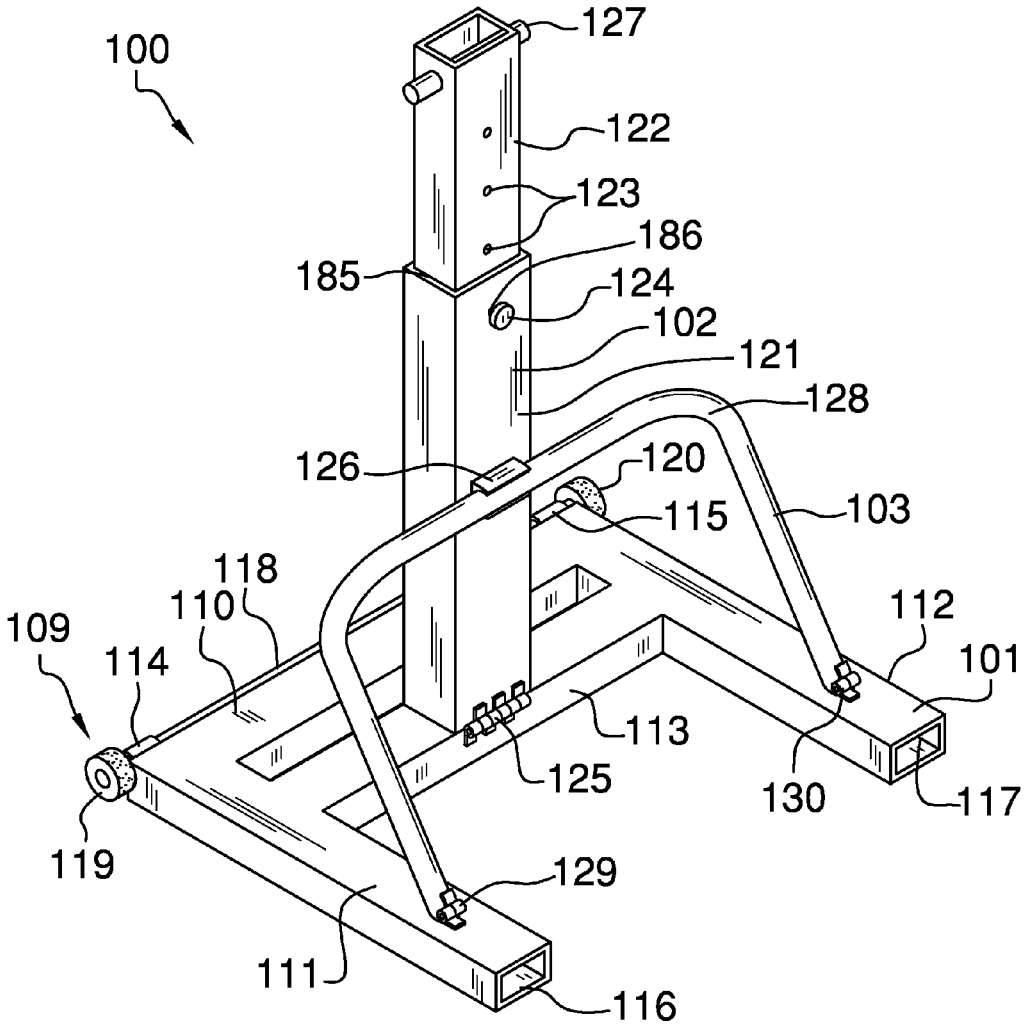
FIG. 1 is a perspective view of an embodiment of the disclosure.
Figure 2:
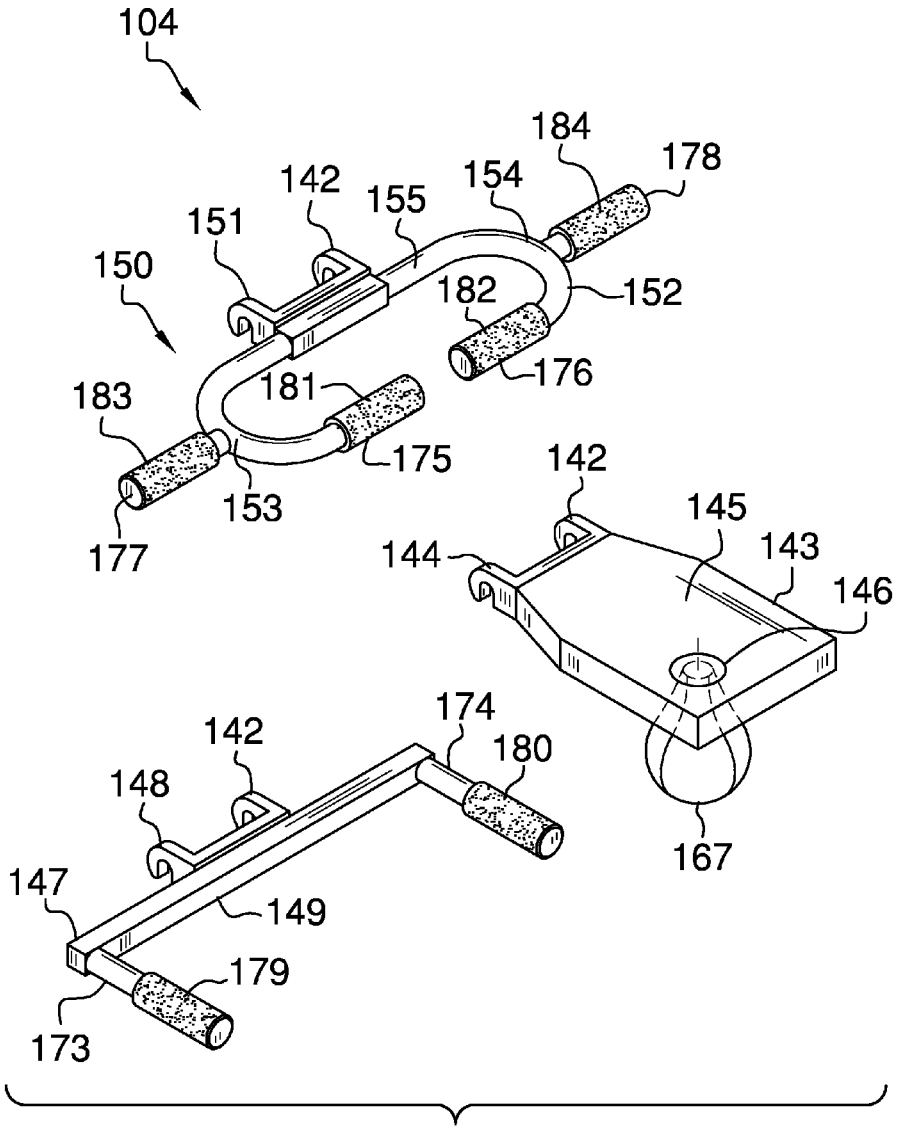
FIG. 2 is a detail view of an embodiment of the disclosure.
Figure 3:
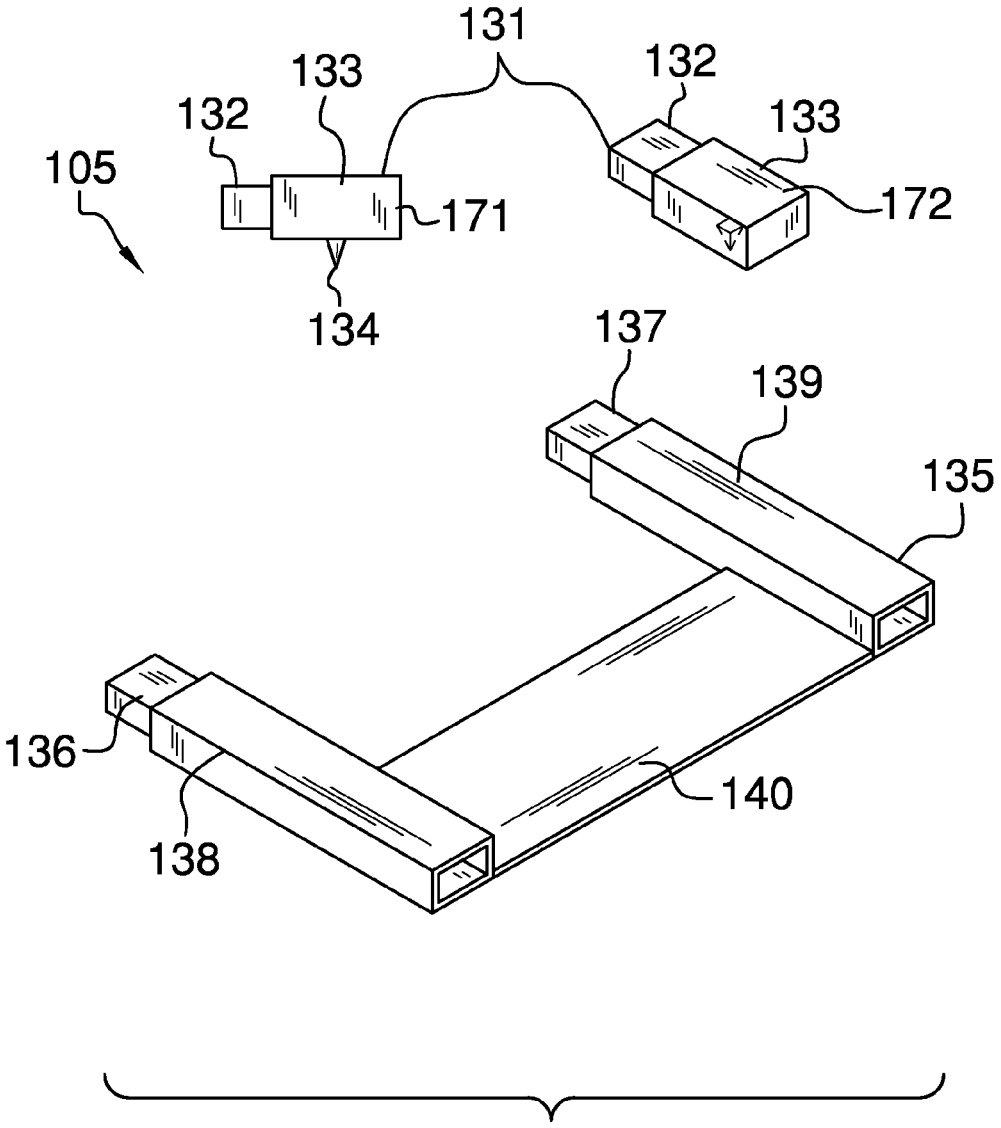
FIG. 3 is a detail view of an embodiment of the disclosure.
Figure 4:
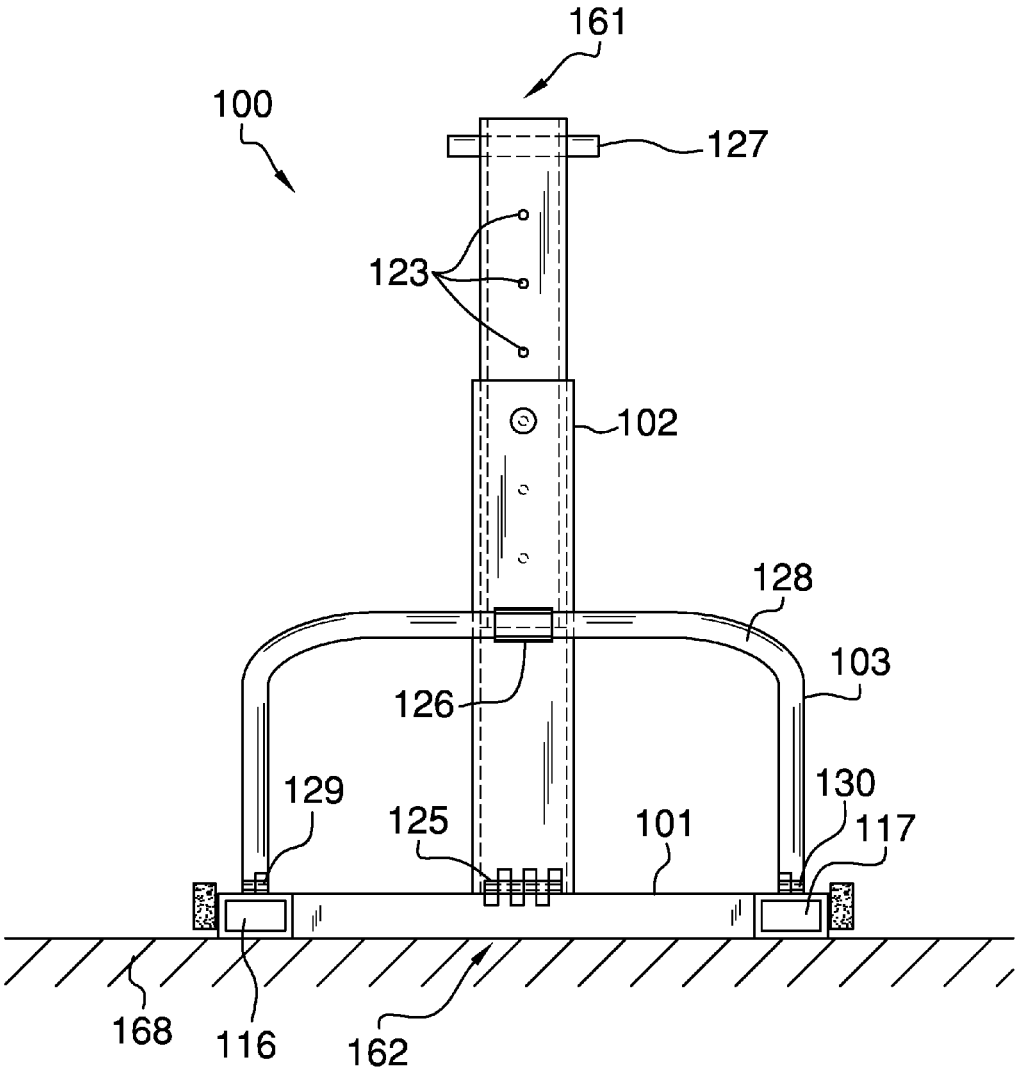
FIG. 4 is a front view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 6.

The pull up dip device 100 (hereinafter invention) comprises a base 101, a post 102, a U bar 103, a plurality of post attachments 104, and a plurality of base attachments 105. The invention 100 is an adjustable exercise device that is adapted for use in performing exercises designed for upper body strength training including, but not limited to, pull ups and dips. The base 101 is the lowest part of the invention 100 and is designed to: 1) rest on a supporting surface 168; and, 2) act as the foundation upon which the rest of the invention 100 is built. The post 102 is attached to the base 101 and projects vertically away from the base 101, and as a result projects vertically away from the supporting surface 168. The vertical extension provided by the post 102 allows gravity to provide the resistance required for upper body strength training. The U bar 103 is a structural support that is used to reinforce the post 102. The plurality of post attachments 104, and the plurality of base attachments 105 allow the invention 100 to be modified to accommodate a variety of upper body strength training exercises and a variety of potential exercise locations. The invention 100 is further designed to be folded for storage.

Except where otherwise noted, all the elements of the invention 100 are made from iron or steel. Except where otherwise noted, when any two elements of the invention 100 are said to be joined together this means they are joined by welding. Except where otherwise noted, when any two elements of the invention 100 are said to be attached means that a designated portion of a first object fits into a port that is provided as a part of a second object. Objects that are attached can be unattached.

The base 101 further comprises a cross strut 110, a left arm 111, a right arm 112, a support strut 113, a left flex strip 114, a right flex strip 115, a left arm insert port 116, a right arm insert port 117, an axle 118, a left wheel 119, and a right wheel 120. The cross strut 110, the left arm 111 and the right arm 112 are rectangular tubes that are joined together to form a U shape. The support strut 113 is a rectangular tube that is joined to the left arm 111 and the right arm 112. Taken together, the cross strut 110, the left arm 111, the right arm 112, and the support strut 113 form an A shape. The opening at the end of the left arm 111 that is distal from the cross strut 110 is called the left arm insert port 116. The opening at the end of the right arm 112 that is distal from the cross strut 110 is called the right arm insert port 117.

Taken together, the axle 118, the left wheel 119, and the right wheel 120 form what is called the wheel assembly 109. The wheel assembly 109 is mounted on the side of the cross strut 110 that is distal from the left arm insert port 116 and the right arm insert port 117. The axle 118 is a commercially available shaft that acts as a fixed axle for the wheel assembly 109. The left wheel 119 is a commercially available wheel and bearing combination that is sized to fit onto the axle 118. The right wheel 120 is a commercially available wheel and bearing combination that is sized to fit onto the axle 118. As shown in FIG. 1, the components of the wheel assembly 109 are sized such that the left wheel 119 and the right wheel 120 extend beyond the left arm 111 and the right arm 112 respectively. The left wheel 119 and the right wheel 120 are not welded to the axle 118 but are instead joined to the axle 118 using commercially available hardware. The axle 118 is not welded to the cross strut 110 but is joined to the cross strut using the left flex strip 114 and the right flex strip 115. The left flex strip 114 is a commercially available flex strip that can be used to attach conduit to a surface. The right flex strip 115 is a commercially available flex strip that can be used to attach conduit to a surface. The left flex strip 114 can be joined to the cross strut 110 by welding or using commercially available hardware. The right flex strip 115 can be joined to the cross strut 110 by welding or using commercially available hardware.

The post 102 further comprises a buttress post 121, an adjustment post 122, a plurality of lock holes 123, an adjustment pin 124, a post hinge 125, a U brace bracket 126, an anchor shaft 127, a fifteenth post port 185 and sixteenth set hole 186.

Figure 5:
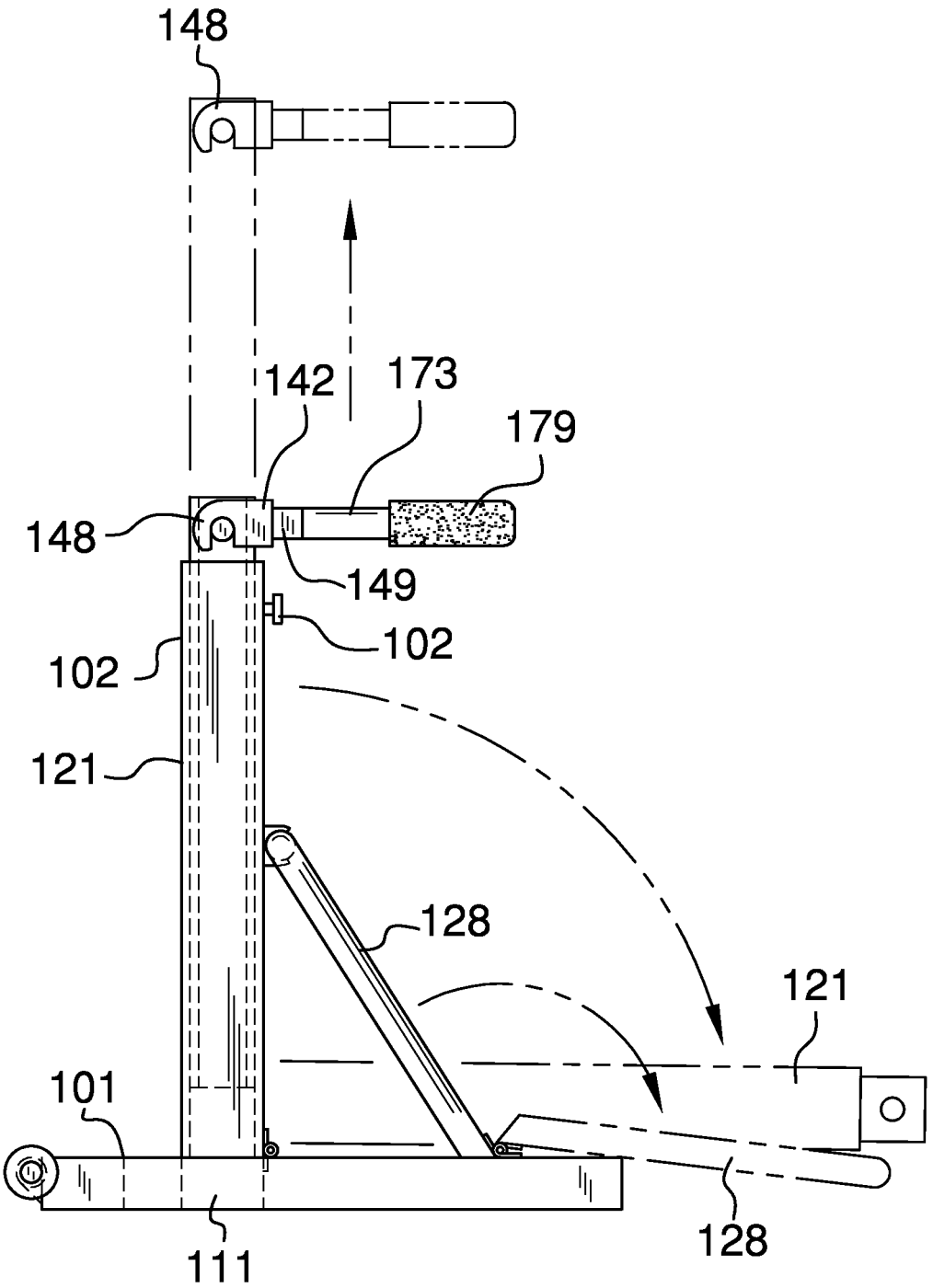
FIG. 5 is a side view of an embodiment of the disclosure.
Figure 6:
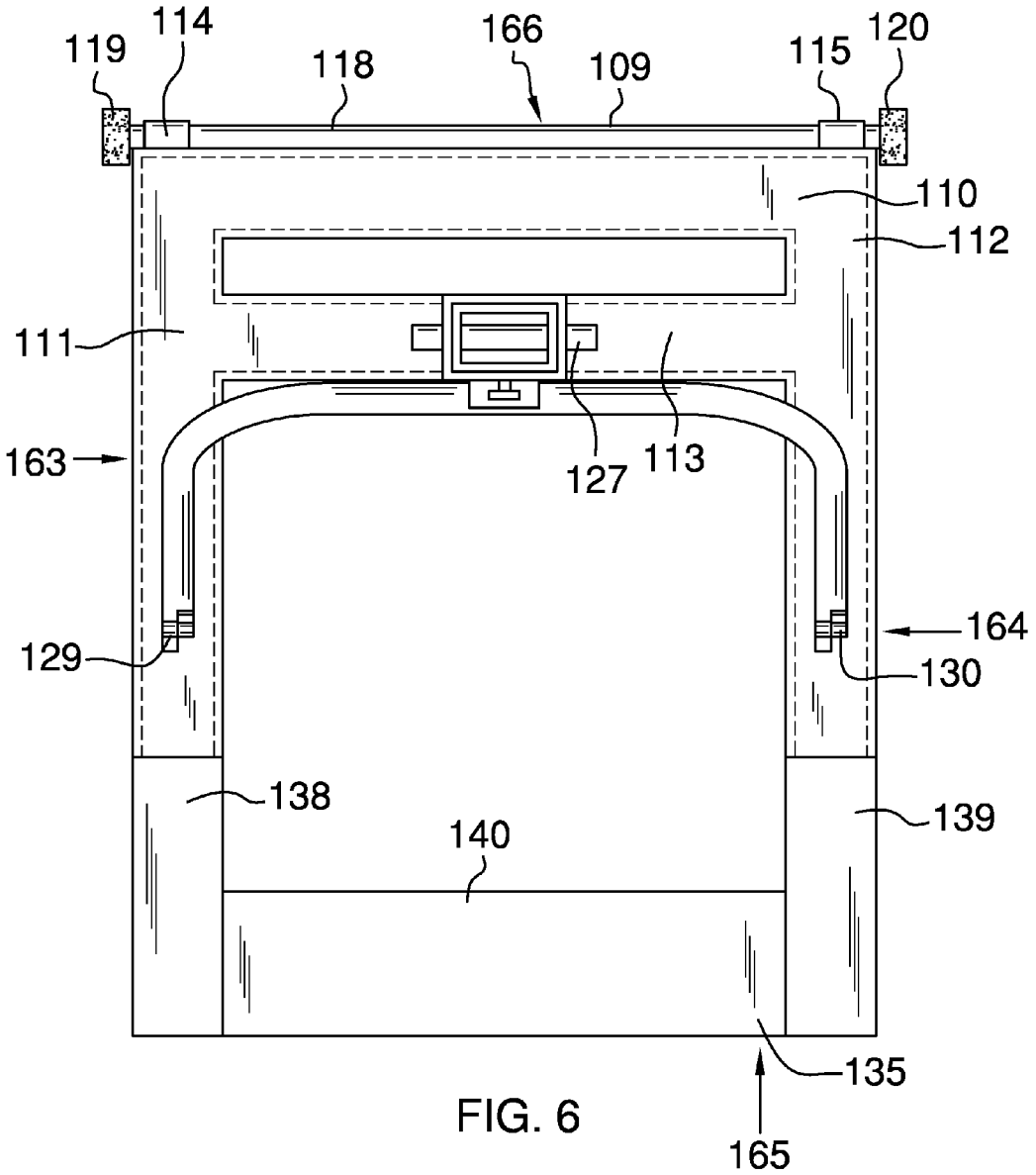
FIG. 6 is a top view of an embodiment of the disclosure.

The buttress post 121 is a rectangular tube that is placed on the support strut 113 such that the buttress post 121 projects perpendicularly away from the support strut 113. The buttress post 121 is not welded to the support strut 113 but is joined to the support strut 113 using the post hinge 125. As shown in FIG. 5, the post hinge 125 is installed such that buttress post 121 can be rotated around the post hinge 125 such that the buttress post 121 lies parallel to the left arm 111 and the right arm 112. The end of the buttress post 121 that is distal from the support strut 113 is called the fifteenth post port 185. The buttress post 121 also has formed in it the sixteenth set hole 186.

The adjustment post 122 is a rectangular tube that is sized such that the adjustment post 122 fits within the buttress post 121. By adjusting the position of the adjustment post 122 relative to the position of the buttress post 121 the invention 100 can be adjusted to accommodate various exercises and users. The adjustment post 122 has formed in it a plurality of lock holes 123. The adjustment post 122 is attached to the buttress post 121 by inserting adjustment post 122 into the fifteenth post port 185 such that the plurality of lock holes 123 can be aligned with the sixteenth set hole 186. When a hole selected from the plurality of lock holes 123 is aligned with the sixteenth set hole 186, the position of the adjustment post 122 relative to the buttress post 121 can be fixed by inserting the adjustment pin 124 through both the sixteenth set hole 186 and the hole selected from the plurality of lock holes 123. The adjustment pin 124 is a commercially available shaft. The end of the adjustment post 122 that is distal from the buttress post 121 has joined to it an anchor shaft 127. The anchor shaft 127 is positioned such that it goes through the adjustment post 122. The anchor shaft 127 is a commercially available shaft. The purpose of the anchor shaft 127 is to provide a location to which the plurality of post attachments 104 can be secured. The face of the buttress shaft 121 that has the sixteenth set hole 186 also has joined to it the U brace bracket 126. The U brace bracket 126 is commercially available hardware clip that is used to secure the U Bar 103 to the post 102.

The U Bar 103 further comprises a U brace 128, a left brace hinge 129 and a right brace hinge 130. The U brace 128 is a U shaped bar that is sized such that the U brace 128 can be secured by the U brace bracket 126. The U brace 128 is not welded to the left arm 111 but is joined to the left arm 111 using the left brace hinge 129. The U brace 128 is not welded to the right arm 112 but is joined to the right arm 112 using the right brace hinge 130. The left brace hinge 129 is a commercially available hinge that is joined to the left arm 111. The right brace hinge 130 is a commercially available hinge that is joined to the right arm 112. As shown in FIG. 5, the U brace 128 is attached to both the left brace hinge 129 and the right brace hinge 130 such that the U brace 128 can be secured by the U brace bracket 126 and so that the U brace 128 can pivot to a position where the U brace 128 lies parallel to the left arm 111 and the right arm 112.

Each of the plurality of post attachments 104 provides a different exercise option for use with the invention 100. Each of the plurality of post attachments 104 is attached to the anchor shaft 127 using a mooring latch 142. The mooring latch 142 is a structure that is joined to each of the plurality of post attachments 104. The mooring latch 142 comprises two hooks that are used to secure the mooring latch 142, and the associated post attachment selected from the plurality of post attachments 104, to the anchor shaft 127.

The plurality of post attachments 104 comprises a speed bag post attachment 143, a dip handle attachment 147, and a pull up attachment 150.

The speed bag post attachment 143 further comprises a speed bag mooring latch 144, a speed bag board 145, and a speed bag swivel 146. The speed bag mooring latch 144 is a mooring latch 142 that is attached to the speed bag board 145. The speed bag board 145 is a plate that acts as a surface against which a speed bag 167 will bounce off during use. The speed bag 167 is connected to the speed bag board 145 using the speed bag swivel 146. The speed bag swivel is commercially available a ball and socket joint that is joined to the speed bag board 145.

The dip handle attachment 147 further comprises a dip handle mooring latch 148, a dip handle cross bar 149, a third grasp 173, a fourth hand grasp 174, a ninth grasp pad 179 and a tenth grasp pad 180. The dip handle cross bar 149 is a rectangular tube that is joined to the dip handle mooring latch 148. On the side of the dip handle cross bar 149 that is distal from where the dip handle mooring latch 148 is joined to the dip handle cross bar 149 is joined the third hand grasp 173 and the fourth hand grasp 174. The third hand grasp 173 and the fourth hand grasp 174 project perpendicularly away from the dip handle cross bar 149 in a direction away from the dip handle mooring latch 148. The third hand grasp 173 is covered with a padding material referred to as the eighth hand grasp 178. The fourth hand grasp 174 is covered with a padding material referred to as the ninth hand grasp 179.

The pull up attachment 150 further comprises a pull up mooring latch 151, a pull up C bar 152, a fifth hand grasp 175, a sixth hand grasp 176, a seventh hand grasp 177, an eighth hand grasp 178, an eleventh grasp pad 181, a twelfth grasp pad 182, a thirteenth grasp pad 183, and a fourteenth grasp pad 184. The pull up C bar 152 is a shaft that formed in a C shape. The pull up C bar 152 is further defined with a pull up left wing 153, a pull up right wing 154, and a pull up long closed side 155. The pull up left wing 153 is at the curve of the pull up C bar 152 on the left 163 side of the invention 100. The pull up right wing 154 is at the curve of the pull up C bar 152 on the right 164 side of the invention 100. The ends of the pull up C bar 152 are referred to as the fifth hand grasp 175 and the sixth hand grasp 176. The pull up long closed side 155 is the side of the pull up C bar 152 opposite to the fifth hand grasp 175 and the sixth hand grasp 176. The pull up mooring latch 151 is joined to the pull up long closed side 155. The seventh handle 177 is a shaft that is joined to and projects perpendicularly away from the pull up left wing 153. The eighth hand grasp 178 is a shaft that is joined to and projects perpendicularly away from the pull up right wing 154. The eleventh grasp pad 181 is padding material that is used to cover the fifth hand grasp 175. The twelfth grasp pad 182 is padding material that is used to cover the sixth hand grasp 176. The thirteenth grasp pad 183 is padding material that is used to cover the seventh hand grasp 177. The fourteenth grasp pad 184 is padding material that is used to cover the eighth hand grasp 178.

Each of the plurality of base attachments 105 are attachments that are inserted into the left arm insert port 116 and right arm insert port 117 and are used to stabilize the invention 100. The plurality of base attachments 105 comprises a plurality of spike sleeves 131 and a speed bag base attachment 135.

The each of the plurality of spike sleeves 131 comprises an insert 132, an extension 133, and a spike 134. The insert 132 and the extension 133 are formed as a single rectangular tube with an insert side 132 and an extension side 133. The insert side 132 is sized to fit within the left arm insert port 116 and the right arm insert port 117. The extension side 133 is sized so that the outer dimensions of the extension side 133 match the outer dimensions of the left arm 111 and the right arm 112. The spike 134 is a metal spike that is joined to the extension 133 such that the spike 134 can be inserted into the supporting surface 168 when the supporting surface 168 is a soft material such as dirt. The purpose of the plurality of spike sleeves 131 is to secure the invention 100 to the ground when the invention 100 is used outdoors. The plurality of spike sleeves 131 further comprises a first spike sleeve 171 and a second spike sleeve 172.

The speed bag base attachment 135 further comprises a left insert 136, a right insert 137, a left extension 138, a right extension 139, and a cross plate 140. The left insert 136 and the left extension 138 are formed as a single rectangular tube with a left insert 136 side and a left extension 138 side. The left insert 136 side is sized to fit within the left arm insert arm port 116 and the right arm insert port 117. The left extension 138 side sized so that the outer dimensions of the left extension side 138 match the outer dimensions of the left arm 111. The right insert 137 and the right extension 139 are formed as a single rectangular tube with a right insert 137 side and a right extension 139 side. The right insert 137 side is sized to fit within the right arm insert port 117. The right extension 139 side is sized so that the outer dimensions of the right extension side 139 match the outer dimensions of the right arm 112. The right extension 139 and left extension 138 are joined using a cross plate 140. The cross plate 140 is a steel plate that is used to stabilize the right extension 139 and left extension 138. The purpose of the speed bag base attachment 135 is to stabilize the invention 100 when the speed bag post attachment 143 is in use.

The following directional references were used in this disclosure:

Directional References: The following directional references are used in this disclosure use the supporting surface 168 the base 101 is placed on as the frame of reference. Specifically, the bottom 162 of the invention 100 is the side of the invention 100 that is placed on the supporting surface 168. The side of the invention 100 distal from the bottom 162 is the top 161 side of the invention 100. The side of the base 101 where the axle 118, left wheel 119 and the right wheel 120 are attached is the rear 166 side of the invention 100. When viewed from the top 161 side, the remaining sides, in clockwise order from the rear 166 side, are the right 164 side, the front side 165 and the left side 163. In this disclosure, when the location of a first object and a second object are compared: 1) if the first object s closer to the top 161 side than the second object, the first object is said to be above the second object and the second object is said to be below the first object; 2) if the first object is closer to the front 165 side than the second object, the first object is said to be in front of the second object and the second object is said to be behind the first object; 3) if the first object s closer to the left 163 side than the second object, the first object is said to be to the left 163 of the second object and the second object is said to be to the right 164 of the first object.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An exercise device comprising:

a base, a post, a U bar, a plurality of post attachments, and a plurality of base attachments;

wherein the exercise device is adapted for use in performing exercises designed for upper body strength training;

wherein the exercise device is adjustable for a plurality of exercises designed for upper body strength training;

wherein the exercise device is adjustable for use by multiple users;

wherein the exercise device is designed to be folded for storage;

wherein the base further comprises a cross strut, a left arm, a right arm, a support strut, a left flex strip, a right flex strip, a left arm insert port, a right arm insert port, an axle, a left wheel, and a right wheel;

wherein the post further comprises a buttress post, an adjustment post, a plurality of lock holes, an adjustment pin, a post hinge, a U brace bracket, an anchor shaft, a fifteenth post port and sixteenth set hole;

wherein the U bar further comprises a U brace, a left brace hinge and a right brace hinge;

wherein each of the plurality of post attachments comprises a mooring latch and is attached to the anchor shaft using the mooring latch.

2. The exercise device according to claim 1 wherein the plurality of post attachments comprises a speed bag post attachment, a dip handle attachment, and a pull up attachment.

3. The exercise device according to claim 2 wherein the plurality of base attachments comprises a plurality of spike sleeves and a speed bag base attachment.

4. The exercise device according to claim 3 wherein each of the plurality of base attachments are inserted into the left arm insert port and right arm insert port.

5. The exercise device according to claim 4 wherein the cross strut, the left arm, and the right arm are rectangular tubes that are joined together to form a U shape.

6. The exercise device according to claim 5 wherein the support strut is a rectangular tube that is joined to the left arm and the right arm.

7. The exercise device according to claim 6 wherein the axle is joined to the cross strut using the left flex strip;

wherein the axle is joined to the cross strut using the right flex strip.

8. The exercise device according to claim 7 wherein the buttress post is a rectangular tube that is placed on the support strut such that the buttress post projects perpendicularly away from the support strut;

wherein the buttress post is joined to the support strut using the post hinge;

wherein the buttress post has formed in it the sixteenth set hole.

9. The exercise device according to claim 8 wherein the post hinge is installed such that buttress post is adapted to be rotated around the post hinge such that the buttress post lies parallel to the left arm and the right arm.

10. The exercise device according to claim 9 wherein the adjustment post is a rectangular tube;

wherein the adjustment post is sized such that the adjustment post fits within the buttress post;

wherein the adjustment post has formed in it a plurality of lock holes.

11. The exercise device according to claim 10 wherein the U brace is a U shaped bar that is sized such that the U brace is adapted to be secured by the U brace bracket;

wherein the U brace is attached to both the left brace hinge and the right brace hinge such that the U brace is adapted to pivot to a position where the U brace lies parallel to the left arm and the right arm.

12. The exercise device according to claim 11 wherein the speed bag post attachment further comprises a speed bag mooring latch, a speed bag board, and a speed bag swivel.

13. The exercise device according to claim 12 wherein the dip handle attachment further comprises a dip handle mooring latch, a dip handle cross bar, a third grasp, a fourth hand grasp, a ninth grasp pad and a tenth grasp pad.

14. The exercise device according to claim 13 wherein the pull up attachment further comprises a pull up mooring latch, a pull up C bar, a fifth hand grasp, a sixth hand grasp, a seventh hand grasp, an eighth hand grasp, an eleventh grasp pad, a twelfth grasp pad, a thirteenth grasp pad, and a fourteenth grasp pad.

15. The exercise device according to claim 14 wherein each of the plurality of spike sleeves comprises an insert, an extension, and a spike.

16. The exercise device according to claim 15 wherein the speed bag base attachment further comprises a left insert, a right insert, a left extension, a right extension, and a cross plate.

* * * * *